US010665970B2

(12) United States Patent
Geske

(10) Patent No.: US 10,665,970 B2
(45) Date of Patent: May 26, 2020

(54) PLUG-IN CONTACT

(71) Applicant: Phoenix Contact GmbH & Co. KG, Blomberg (DE)

(72) Inventor: Ralf Geske, Schieder-Schwalenberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/774,774

(22) PCT Filed: Nov. 10, 2016

(86) PCT No.: PCT/EP2016/077340
§ 371 (c)(1),
(2) Date: May 9, 2018

(87) PCT Pub. No.: WO2017/081197
PCT Pub. Date: May 18, 2017

(65) Prior Publication Data

US 2018/0351271 A1 Dec. 6, 2018

(30) Foreign Application Priority Data

Nov. 11, 2015 (DE) ..... 10 2015 119 484

(51) Int. Cl.
*H01R 12/58* (2011.01)
*H01R 12/70* (2011.01)
*H01R 12/75* (2011.01)

(52) U.S. Cl.
CPC ..... *H01R 12/585* (2013.01); *H01R 12/7023* (2013.01); *H01R 12/75* (2013.01)

(58) Field of Classification Search
CPC .. H01R 4/4818; H01R 4/4827; H01R 4/4836; H01R 12/585; H01R 12/75; H01R 12/7023; H01R 9/091
(Continued)

(56) References Cited

U.S. PATENT DOCUMENTS 3,820,061 A * 6/1974 Holden ..... H05K 3/308 439/65
3,867,004 A * 2/1975 Komorowski ..... H01R 4/52 439/437

(Continued)

FOREIGN PATENT DOCUMENTS

DE 10 2008 039 232 A1 2/2010
DE 10 2009 004 513 A1 7/2010

(Continued)

OTHER PUBLICATIONS

Dr. Klaus Wittig, elektroniknet.de Detachable Direct Connection to the Printed Circuit Board Plugging Instead of Pressing; Retrieved From the Internet; May 7, 2014; pp. 1-6.

*Primary Examiner* — Gary F Paumen
(74) *Attorney, Agent, or Firm* — David S. Safran; Roberts Calderon Safran & Cole, P.C.

(57) ABSTRACT

A plug contact for electrically contacting a circuit board by insertion of the plug contact into a contact hole of the circuit board, the plug contact having two resilient contact legs, a terminal region, and a connecting region which connects the two contact legs to one another and to the terminal region, wherein the plug contact is punched out of a metallic flat material in one piece. As a result, the plug contact only has a small overall height, and the two contact arms each have a first region and a second region which are arranged at an angle α relative to one another, such that the two contact legs are bent approximately in an L shape, and wherein the two first regions adjoin the connection region and the ends of the two second regions form the free ends of the contact legs.

9 Claims, 6 Drawing Sheets

(58) Field of Classification Search
USPC ..... 439/441, 82, 751
See application file for complete search history.

(56) References Cited

U.S. PATENT DOCUMENTS

| | | | | | |
|---|---|---|---|---|---|
| 4,793,817 | A * | 12/1988 | Hiesbock | H01R 12/585 | 439/751 |
| 5,709,556 | A * | 1/1998 | Tan | H01R 12/7029 | 439/567 |
| 6,244,904 | B1 * | 6/2001 | Fabian | H01R 4/4836 | 439/268 |
| 6,302,748 | B1 * | 10/2001 | Xu | H01R 13/41 | 439/751 |
| 6,984,135 | B2 * | 1/2006 | Kaneko | H01R 12/585 | 439/82 |
| 7,891,992 | B2 * | 2/2011 | Veigel | H01R 43/16 | 439/82 |
| 8,840,408 | B2 | 9/2014 | Baba et al. | | |
| 8,992,236 | B2 * | 3/2015 | Wittig | H01R 12/585 | 439/82 |
| 9,356,367 | B2 | 5/2016 | Vino, IV et al. | | |
| 2002/0187670 | A1 * | 12/2002 | Cisey | H01R 9/2666 | 439/441 |
| 2003/0114027 | A1 * | 6/2003 | Wurster | H05K 3/366 | 439/82 |

FOREIGN PATENT DOCUMENTS

| | | | |
|---|---|---|---|
| DE | 10 2011 011 017 | A1 | 8/2012 |
| WO | 2010/015571 | A1 | 2/2010 |

* cited by examiner

PLUG-IN CONTACT

BACKGROUND OF THE INVENTION

Field of the Invention

The invention relates to a plug-in contact for making electrical contact with a circuit board by means of plugging the plug-in contact into a contact hole of the circuit board, with two contact legs which are resilient relative to one another, one terminal region and one connecting region which connects the two contact legs to one another and to the terminal region, the plug-in contact being punched out of a metallic flat material.

Moreover, the invention also relates to an electrical terminal with a housing, with a spring clip and with a busbar piece, the spring clip having one clamping leg and one contact leg and the clamping leg with the busbar piece forming a spring force clamp terminal for an electrical lead which is to be connected, and in the housing a lead insertion opening for inserting an electrical lead which is to be connected and an actuation opening for opening the spring force clamp terminal being made.

Plug-in contacts for producing electrical and/or electronic connections between leads, different components or the like and busbars are known in different embodiments and for different applications. The plug-in contacts are plugged into corresponding receiving contacts or jack elements for this purpose; the receiving contacts can be for example corresponding openings in busbars or the like. The plug-in contacts themselves can be connected to electrical components or can be provided for connection to electrical leads, for which the terminal region of the plug-in contacts is made accordingly.

There are different techniques for the connection between a circuit board and an electrical component, in practice mainly soldering and forcing-in having established themselves. Both techniques have proven effective over the years since they ensure good and permanent electrical contact between the contact partners. One disadvantage both of soldering and forcing-in is that the two connecting techniques are not reversible, so that a connection, once established, cannot be broken again or can be at least only with increased effort. Moreover, additional working steps and/or special tools are necessary to establish the connection. Here plug-in connections which have been used for decades in other applications offer one alternative since the connection can be easily established and moreover can also be broken again by hand, is therefore reversible.

Electrical terminals have also been known for decades in a host of embodiments. The terminals can be made for example for connection to one electrical lead or several leads to a circuit board as a so-called printed terminal, for which the terminals have corresponding contact pins which are forced or soldered into the holes in the circuit board. Spring clips are both loop-shaped spring clips, so-called tension spring clips, and also U-shaped or V-shaped spring clips into which rigid leads or leads provided with a wire end ferrule can be plugged directly, i.e., without the clamping site having to be opened beforehand with a tool. To connect flexible leads the clamping site between the clamping leg and the busbar piece must be opened, for which in the housing an actuation opening is made for insertion of a tool, for example the tip of a screwdriver. In the known U-shaped or V-shaped spring clips the lead which is to be connected is pressed by the clamping leg against the busbar piece, as a result of which the electrical connection between the lead and the busbar piece is established.

Description of the Related Art

German Patent Application DE 10 2008 039 232 A1 discloses an electrical terminal which however is not made as a printed terminal, but as part of a terminal block. The known terminal has an actuating pusher which is movably located in an actuation opening made in the housing. Using the actuating pusher, the clamping site can be opened when the actuating pusher is pressed into the housing.

For some time, a plug-in contact which was made for use in circuit boards has been known from practice; it is made in the manner of a spring yoke and has two flat contact legs which are resilient relative to one another and which are connected to one another via a common connecting region. A terminal with several of these plug-in contacts is known from German Patent Application DE 10 2011 011 017 A1. The individual plug-in contacts are arranged in several rows next to one another in chambers of the adapter box such that the plug-in contacts extend perpendicular to the plane of the circuit board. To connect individual leads the terminal regions are made as crimp terminals for the individual plug-in contacts. In this way, several leads can be connected to one circuit board in which the individual contact holes have a short distance to one another, but the individual plug-in contacts and thus also the terminal have a relatively great overall height. Moreover, later connection or disconnection of individual leads is not possible in the known terminal.

SUMMARY OF THE INVENTION

Therefore, the object of this invention is to make available the initially described plug-in contact which has an overall height as small as possible. Moreover, an electrical terminal with which an electrical lead can be easily connected to a circuit board will be devised.

This object is achieved in the initially described plug-in contact with the features of claim 1 in that the two contact legs each have a first region and a second region, the two regions being arranged at an angle $\alpha$ to one another so that the contact legs are bent roughly in an L-shape. The respectively first region of the two contact legs adjoins the connecting region, while the ends of the second regions form the free ends of the contact legs with which the contact legs are plugged beforehand into the corresponding contact hole of a circuit board.

In contrast to the plug-in contacts known from the prior art, in the plug-in contact in accordance with the invention the two contact legs thus do not extend in one plane, but are bent, the angle between the two regions of the contact legs preferably being 90°. If the second region of the contact legs with the free ends runs perpendicular to the plane of the circuit board into whose contact hole the plug-in contact is being plugged, the first region of the contact legs thus extends roughly parallel to the plane of the lead surface.

Due to the bending of the contact legs, the overall height of the plug-in contact is reduced. Moreover, the plug-in contact in accordance with the invention has the advantage that the working region of the plug-in contact which is active when the contact legs are being plugged into the contact hole, i.e., the region which produces the reset force of the plug-in contact, lies essentially in the first region of the contact legs. The contact legs in this region are stressed primarily in torsion and not in bending; this leads to the plug-in contact being more elastic compared to a plug-in contact with straight, unbent contact legs. The plug-in contact can thus be more easily plugged into a contact hole or withdrawn again from the contact hole, as claimed in According to one advantageous configuration of the plug-in contact in accordance with the invention, the terminal region and the second regions of the two contact legs run essentially parallel to one another. The terminal region thus extends, in the same way as the second regions of the two contact legs, perpendicular to the plane of a circuit board into whose contact hole the plug-in contact is to be plugged so that the plug-in contact is bent altogether twice.

According to another especially preferred configuration of the invention, the two contact legs have different lengths, i.e., there are a first longer contact leg and a second shorter contact leg. On the free end of the longer contact leg a guide section is made which is located in the plug-in direction of the plug-in contact upstream of the free end of the shorter contact leg. The guide section is used here as a feed and centering aid when the plug-in contact is being plugged into the corresponding contact hole in a circuit board. For this purpose, the guide section on its side which faces away from the connecting region and thus which faces the contact hole when being plugged in preferably has a wedge-shaped or semicircular outside contour. When the plug-in contact is being plugged into the contact hole, first the guide section of the first longer contact leg thus slides into the contact hole before the second shorter contact leg also dips into the contact hole, the two contact legs then being forced onto one another by the contact wall of the contact hole so that the distance between the two contact legs decreases compared to the unplugged state.

Another configuration of the invention calls for the two contact legs to have a wave-shaped outside contour which extends in the longitudinal direction. Preferably, the region of the crest of the wave-shaped outside contour of the contact legs forms the contact-making region of the contact legs, which region makes contact with the contact hole in the plugged-in state. In the plugged state of the plug-in contact the two contact legs are then bent at maximum toward one another so that the normal contact force is maximum between the contact legs and the inner wall of the contact hole. When the plug-in contact is being plugged into the contact hole the insertion force is however small enough that the plug-in contact by itself or located together with several plug-in contacts in a higher-pin plug can be easily mounted by hand.

According to another advantageous configuration of the plug-in contact in accordance with the invention, the two contact legs have an outside contour which is rounded in cross section at least in their contact region. The outside edges of the contact legs are thus machined in the region in which the contact legs in the plugged-in state make contact with the contact hole such that they have no sharp edges. For this reason, the outside contour of the contact legs can have a radius which is smaller than the radius of the contact hole. This makes it possible to plug in and pull out the plug-in contact several times without major damage on the inside wall of the contact hole in the circuit board. Without the advantageously provided rounded outside contour, after a few plugging cycles grooves can appear in the wall of the contact hole by which the surface of the wall of the contact hole can be damaged.

The initially named object is achieved with the features of the electrical terminal in accordance with the invention which has a plug-in contact in accordance with the invention which is arranged at least partially in the housing such that the busbar piece is formed by the terminal region of the plug-in contact. The spring force clamp terminal is thus formed by the clamping leg of the spring clip and the terminal region of the plug-in contact, the contact legs of the plug-in contact with their second regions protruding from the bottom of the housing. The bottom of the housing is considered the side which faces the circuit board when the terminal is being placed on the circuit board.

Because the electrical terminal has a plug-in contact in accordance with the invention, the terminal can also have a relative small overall height. Moreover, a lead which is to be connected can be easily connected via the spring force clamp terminal to the terminal and thus also to a circuit board. If necessary, the electrical lead can also be withdrawn again from the terminal when the spring force clamp terminal is being opened so that the electrical connection between the lead and the circuit board can also be broken again.

If in the electrical terminal in accordance with the invention the terminal region runs parallel to the second regions of the two contact legs, the lead insertion opening is located on the top of the housing and an electric lead which is to be connected is plugged into the terminal perpendicular to the plane of the circuit board. In doing so the electrical lead is then pressed by the free end of the contact leg against the terminal region of the plug-in contact, as a result of which the electrically conductive connection between the lead and the plug-in contact is established. Disconnection of the lead from the terminal is easily possible by the clamping site being opened, for which the clamping leg of the spring clip is deflected against its spring force by means of a tool which has been inserted into the actuation opening or by means of an actuating pusher which is located in the actuation opening. The lead can then be withdrawn again from the clamping site between the clamping leg and the terminal region of the plug-in contact.

In order to achieve good electrical contact between a plugged-in electrical lead and the plug-in contact, on the side of the terminal region of the plug-in contact facing the clamping leg several grooves or indents are preferably made. This structure of the terminal region increases the compressive load per unit area between the plugged-in lead and the plug-in contact; this leads to lower contact resistance.

For simple mounting of the electrical terminal on a circuit board, according to another advantageous configuration it is provided that on the bottom of the housing several adjusting elements are made which, when the terminal is being placed on the circuit board, are inserted into corresponding recesses in the circuit board. The ends of the adjusting elements are preferably made conical here; this facilitates the insertion of the adjusting elements into the corresponding recesses in the circuit board. Moreover, the length of the adjusting elements is chosen such that when the terminal is being placed on the circuit board the adjusting elements with their free ends first engage the corresponding recesses in the circuit board before the free ends of the contact legs of the plug-in contact dip into the corresponding contact holes in the circuit board.

According to another advantageous configuration of the electrical terminal in accordance with the invention, in addition to the adjusting elements several locking elements are made on the bottom of the housing which engage corresponding recesses in the circuit board. Corresponding locking projections or locking lugs can ensure that the electrical terminal after being placed on a circuit board is reliably fastened to it. Preferably the locking elements are made such that they can be transferred out of a first non-locking state into a second locking state and vice versa. This makes it possible to disengage the locking between the housing of the electrical terminal and the circuit board again so that the electrical terminal can be again lifted off the circuit board if necessary.

In particular, at this point there are a host of possibilities for configuring and developing the plug-in contact in accordance with the invention as well as the electrical terminal in accordance with the invention as will be apparent from the following description of preferred exemplary embodiments in conjunction with the drawings.

DETAILED DESCRIPTION OF THE INVENTION

Figure 1:
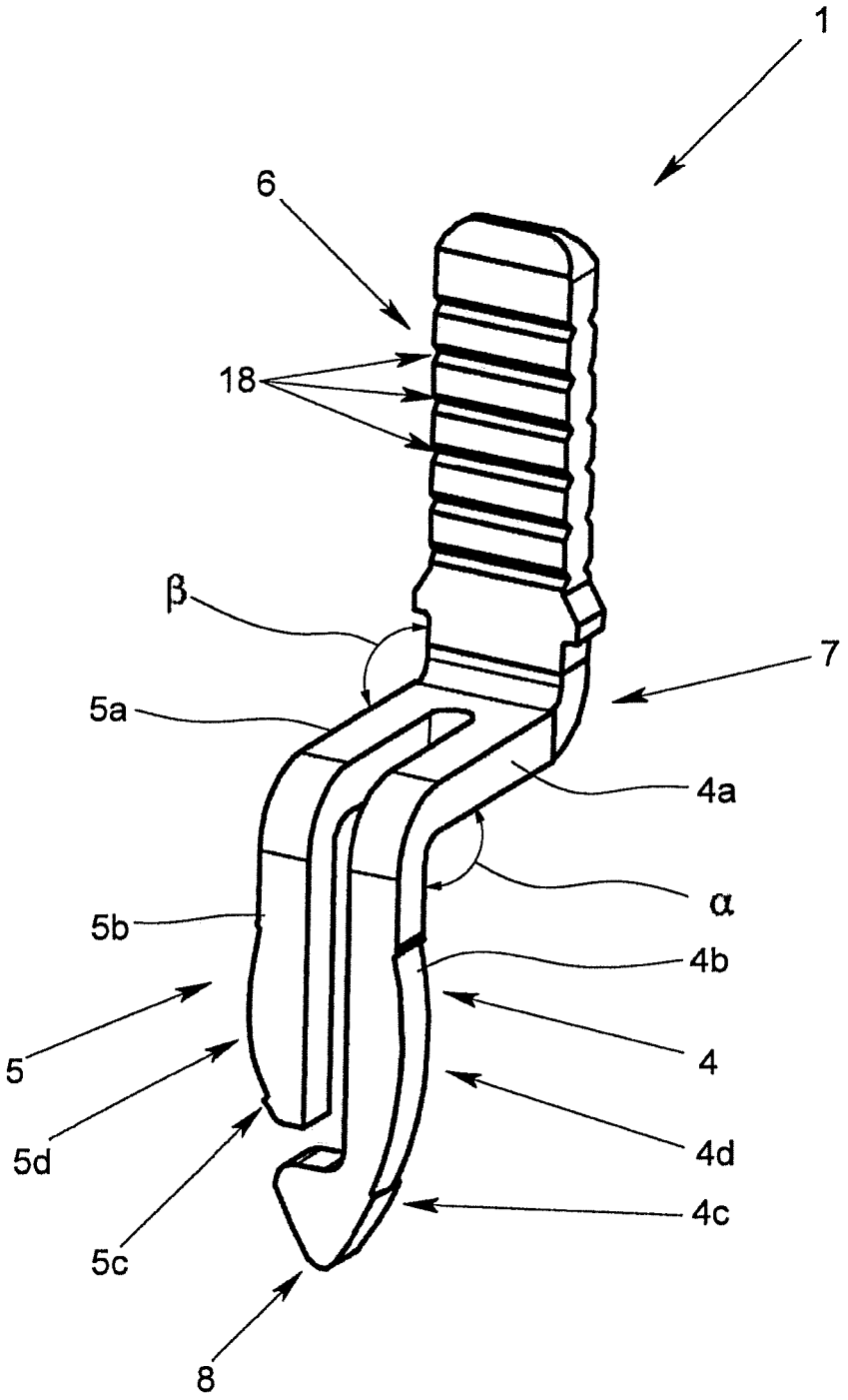
FIG. 1 shows a perspective of a preferred exemplary embodiment of a plug-in contact in accordance with the invention.
Figure 2:
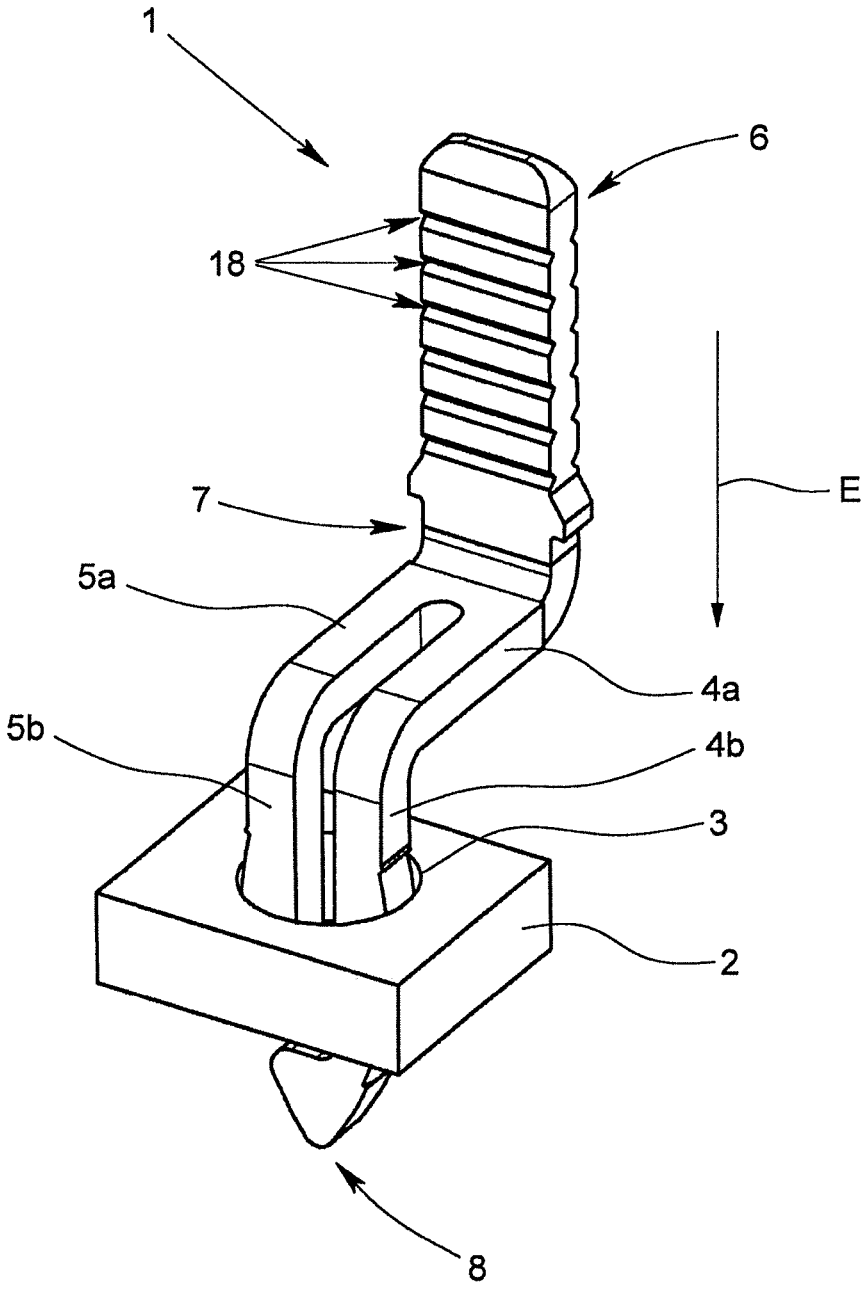
FIG. 2 shows a cutaway portion of a circuit board with a plug-in contact which has been plugged in according to FIG. 1.

FIGS. 1 and 2 show a plug-in contact 1 for making contact with a circuit board 2, for which the plug-in contact 1 is plugged into a corresponding contact hole 3 in the circuit board 2. The plug-in contact 1 which is punched out of a metallic flat material and bent has two contact legs 4, 5 which are resilient relative to one another, one terminal region 6 and one connecting region 7, the two contact legs 4, 5 being connected to one another and to the terminal region 6 via the connecting region 7.

The two contact legs 4, 5 each have a first region 4*a*, 5*a* and a second region 4*b*, 5*b* which are arranged at an angle $\alpha$ to one another. The angle $\alpha$ in the preferred exemplary embodiment which is shown in the figures is roughly 90° so that the two contact legs 4, 5 are bent roughly in an L shape. As is apparent from the figures, the two contact legs 4, 5 run parallel to one another so that the angle between the two regions 4*a*, 4*b* of the first contact leg 4 corresponds to the angle between the two regions 5*a*, 5*b* of the second contact leg 5. The two first regions 4*a*, 5*a* of the contact legs 4, 5 which run horizontally in the alignment shown in FIGS. 1 and 2 adjoin the connecting region 7 so that the ends of the two second regions 4*b*, 5*b* which run vertically in the illustration form the free ends 4*c*, 5*c* of the contact legs 4, 5.

In the illustrated preferred exemplary embodiment of the plug-in contact 1, the terminal region 6 and the second regions 4*b*, 5*b* of the two contact legs 4, 5 run parallel to one another so that the first regions 4*a*, 5*a* of the contact legs 4, 5 and the terminal region 6 are also arranged at an angle $\beta$ to one another which is likewise roughly 90°. In the illustrated arrangement of the plug-in contact 1, the second regions 4*b*, 5*b* of the two contact legs 4, 5 and the terminal region 6 thus extend perpendicular to the plane of the circuit board 2, while the first regions 4*a*, 5*a* of the two contact legs 4, 5 extend parallel to the plane of the circuit board 2.

As is apparent from the figures, the two contact legs 4, 5 have different lengths, on the free end 4*c* of the longer first contact leg 4 there being a guide section 8 which in the plug-in direction E of the plug-in contact 1 is located upstream of the free end 5*c* of the shorter second contact leg 5. The guide section 8 is used here as a feed and centering aid when the plug-in contact 1 is being plugged into the corresponding contact hole 3 of the circuit board 2. For this purpose, the guide section 8 on its side facing away from the terminal region 6 and facing the contact hole 3 when being plugged in has a wedge-shaped outside contour which dips first into the contact hole 3 as the plug-in contact 1 is being plugged in.

FIG. 1 moreover shows that the contact legs 4, 5 in their second regions 4*b*, 5*b* have a wave-shaped outside contour which extends in the longitudinal direction, the contact-making region 4*d*, 5*d* of the contact legs 4, 5 being located in the region of the crest of the wave-shaped outside contour. In the plugged-in state of the plug-in contact 1 the two contact legs 4, 5 are thus bent at maximum toward one another so that the normal contact force between the contact legs 4, 5 and the inside wall 9 of the contact hole 3 is maximum. When the plug-in contact 1 is being plugged into the contact hole 3, the insertion force is however small enough that the plug-in contact 1 by itself or even located together with several plug-in contacts 1 in a higher-pin terminal 10 can be easily mounted by hand. If the contact legs 4, 5 are plugged into the contact hole 3 so that the first regions 4*b*, 5*b* are bent toward one another, the contact legs 4, 5 in their first regions 4*a*, 5*a* are thus stressed in torsion so that the plug-in contact 1 is more elastic than if the contact legs were stressed only in bending.

Figure 3:
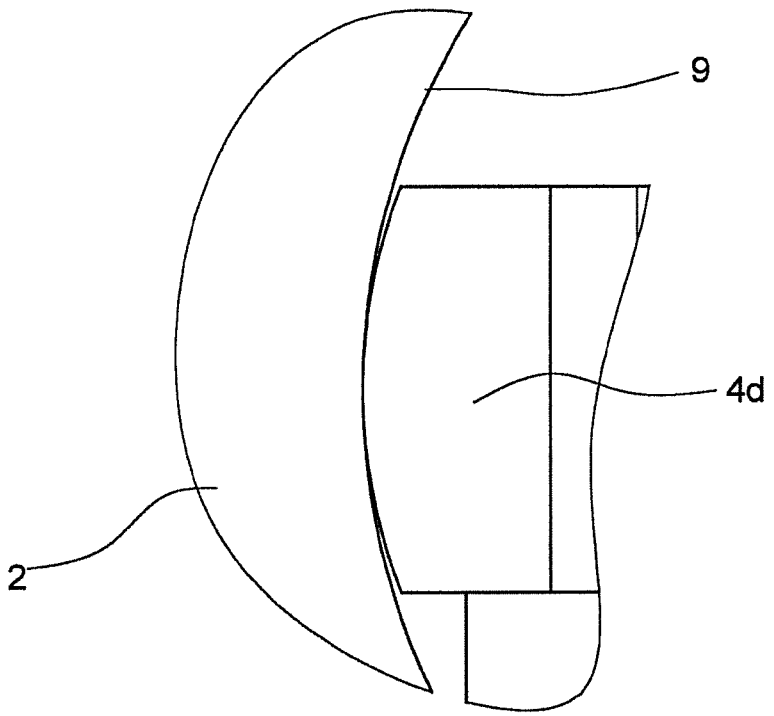
FIG. 3 shows am enlarged detail of a contact leg plugged into a contact hole, in cross section.

It is apparent from the enlarged cross section of the contact leg 4 plugged into the contact hole 3 according to FIG. 3 that the contact leg 4 at least in the contact-making region 4*d* has an outside contour which is rounded in cross section. Accordingly, the outside contour of the second contact leg 5 is also rounded in cross section in the contact-making region 5*d*. The contact leg 4 is machined here such that the outside contour in the contact-making region 4*d* does not have edges, but is rounded or provided with a radius. The radius of the outside contour is somewhat smaller than the radius of the contact hole 3 so that damage to the inside wall 9 of the contact hole 3 when the contact legs 4, 5 are being plugged in is prevented in the contact hole 3. This leads to a plug-in contact 1 which has been made in this way enabling more plug-in and withdrawal cycles than would be the case for a plug-in contact 1 in which the outside contour of the contact legs is not rounded. Due to the edges, after a few plug-in cycles grooves can form in the inside wall 9 of the contact hole 3, as a result of which the surface of the inside wall 9 of the contact hole 3 can be damaged.

Figure 4A:
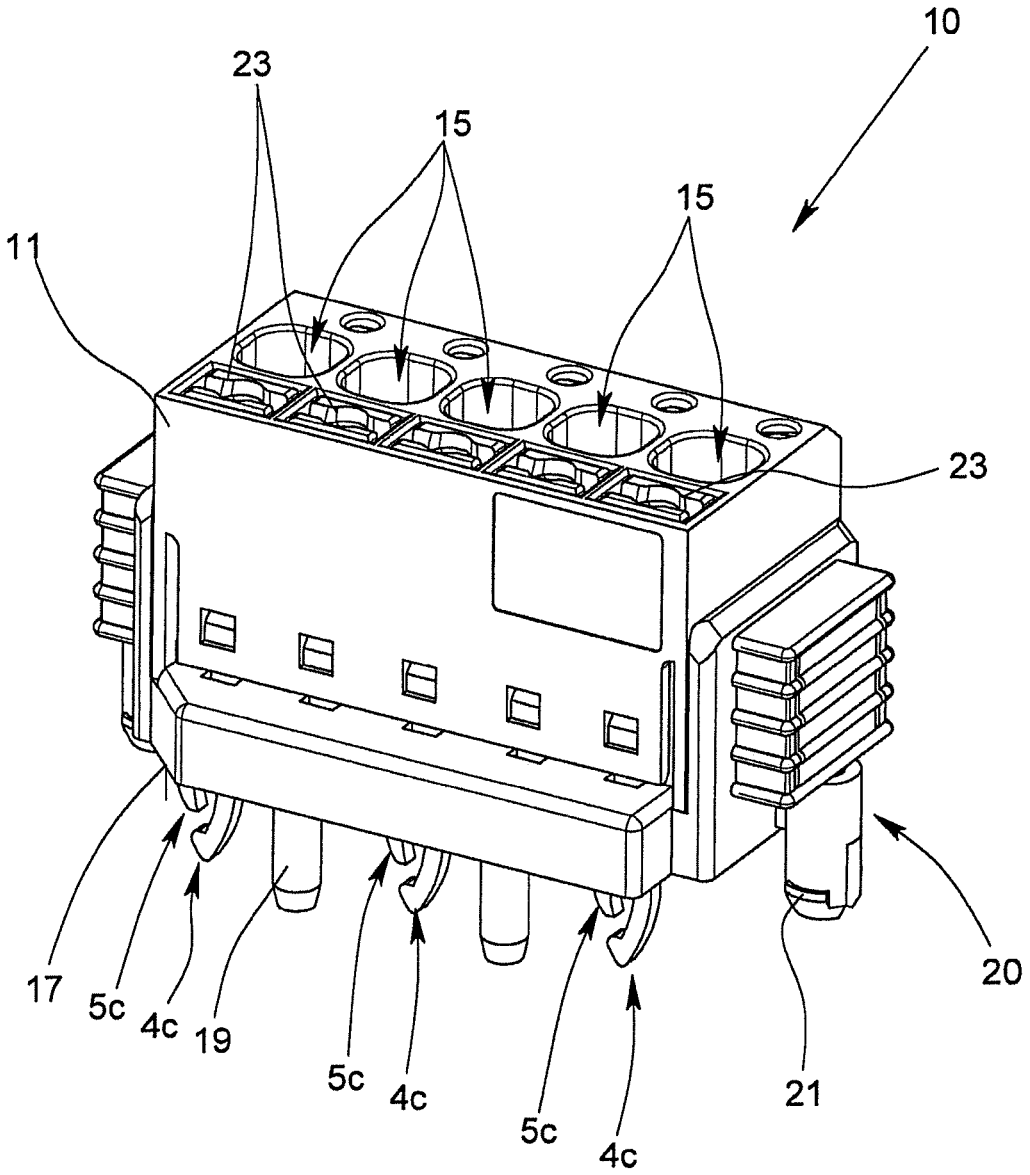
FIGS. 4*a* & 4*b* show a preferred exemplary embodiment of an electrical terminal in accordance with the invention, in a perspective view, obliquely from overhead and obliquely from the underneath, respectively.
Figure 4B:
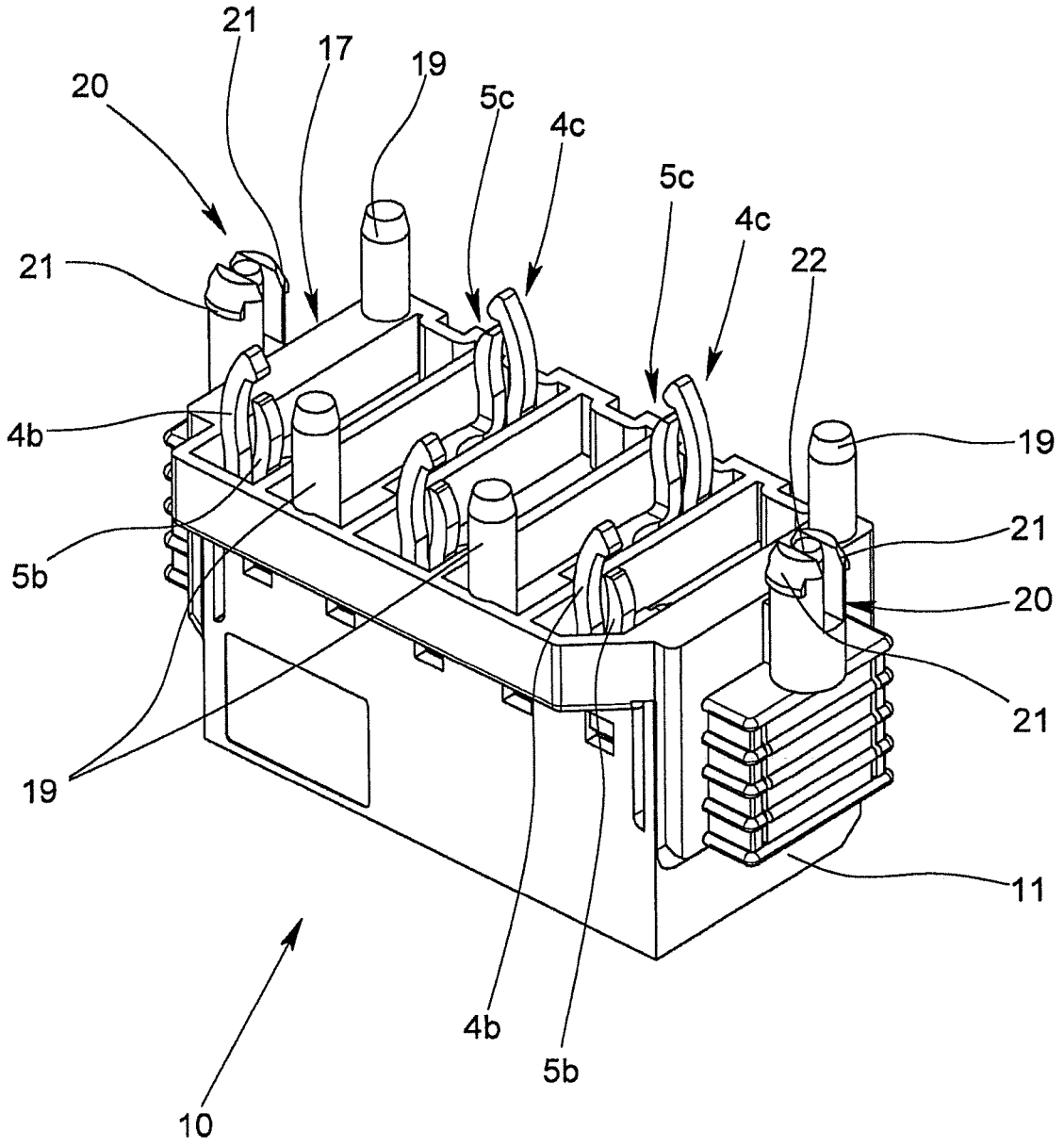
Figure 5:
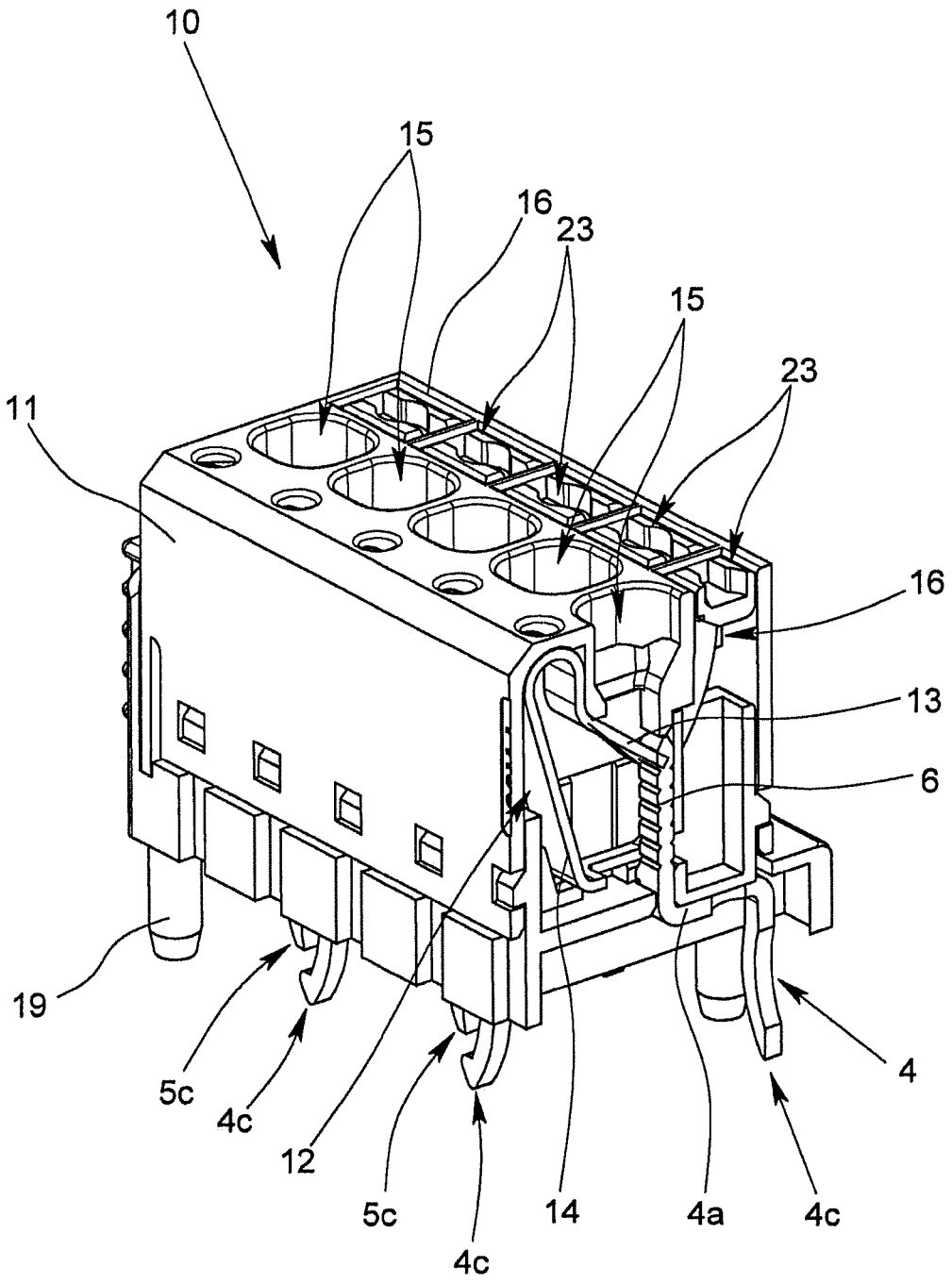
FIG. 5 shows the electrical terminal according to FIG. 4, in cross section.

FIGS. 4*a*, 4*b* & 5 show a preferred exemplary embodiment of an electrical terminal 10 in accordance with the invention which has a generally plastic housing 11 in which there are several spring clips 12. The exemplary embodiment of the electrical terminal 10 shown in the figures is used to connect five individual leads so that there is also a total of five spring clips 12 in the housing 11. The individual spring clips 12, of which FIG. 5 shows one in the cross section of the terminal 10, each have one clamping leg 13 and one contact leg 14.

Each spring clip 12 is assigned one plug-in contact 1 such that the terminal region 6 of one plug-in contact 1 together with the free end of the clamping leg 13 of one spring clip 12 forms a spring force clamp terminal for an electrical lead which has been inserted into the housing 11 through a lead insertion opening 15. Since the terminal 10 is designed for connection of five leads, in the housing 11 five lead insertion openings 15 and five actuation openings 16 are also made accordingly for opening of one spring force clamp terminal at a time. In particular, it is apparent from the representation of the terminal 10 from obliquely underneath according to FIG. 4*b* that the individual contact legs 4, 5 with their second regions 4*b*, 5*b* and in particular the free ends 4*c*, 5*c* protrude from the bottom 17 of the housing 11 so that the individual free ends 4*c*, 5*c* of the contact legs 4, 5 engage corresponding contact holes 3 in a circuit board when the electrical terminal 10 is being placed on the circuit board 2.

Because each of the contact legs 4, 5 of the plug-in contacts 1 is bent in an L shape, the first regions 4*a*, 5*a* run parallel to the plane of the circuit board 2 so that height of the electrical terminal 10 is reduced. As is apparent from FIG. 4*b*, adjacent plug-in contacts 1 are each arranged offset by 180° to one another, as a result of which a greater distance between the free ends 4*c*, 5*c* of adjacent plug-in contacts 1 is achieved without the width of the terminal 10 being increased. The terminal 10 can have altogether very small dimensions for this reason.

To ensure good electrical contact between a connected electrical lead and the terminal region 6 of a plug-in contact 1, on the side of the terminal region 6 facing the clamping leg 13 several grooves 18 are made, as a result of which the compressive load per unit area between a plugged-in lead which has been forced by the end of the clamping leg 13 against the terminal region 6 and the terminal region 6 is increased.

To fasten the housing 11 of the electrical terminal 10 on a circuit board 2, on the bottom 17 of the housing several adjusting elements 19 arranged offset to one another as well as on the two front sides of the housing 11 two locking elements 20 are made which each protrude beyond the bottom 17 of the housing 11 and can be plugged into corresponding recesses in a circuit board 2. To produce the locking in the corresponding recesses in the circuit board, the two locking elements 20 each have two opposing locking lugs 21. A locking pin 22 which is made movable in the longitudinal direction of the locking element 20 and which is located between opposing locking lugs 21 prevents the locking lugs 21 from unintentionally springing back if the locking pin 22 is in the locking position shown in FIG. 4*b* between the two locking lugs 21.

In order to be able to easily open the clamping site between the free end of the clamping leg 13 of the spring clip 12 and the opposing terminal region 6 of a plug-in contact 1, one actuating pusher 23 at a time is movably located in the actuation openings 16. If the actuating pusher 23 is forced into the actuation opening 16 of the housing 11, the actuating pusher 23 deflects the clamping leg 13 of the spring clip 12 against its spring force so that a connected lead can be withdrawn from the clamping site or a flexible lead can be inserted into the clamping site.

What is claimed is:

1. A plug-in contact for making electrical contact with a circuit board by plugging the plug-in contact into a contact hole of the circuit board, comprising:

two contact legs which are resilient relative to one another, a terminal region and a connecting region which connects the two contact legs to one another and to the terminal region, wherein the two contact legs and the connecting region of the plug-in contact are made of a metallic material in one piece, wherein the two contact legs each have a first region and a second region which are arranged at an angle α to one another so that the two contact legs are bent substantially in an L-shape, wherein the first regions adjoin the connecting region and ends of the second regions form free ends of the contact legs, wherein the second regions of two contact legs each have a contact-making region which makes contact with the contact hole in a plugged-in state creating an electrical conducting path from the contact-making region to the terminal region, and wherein the two contact legs have an outside contour which is rounded in cross section at least in the contact-making region which makes contact with the contact hole in the plugged-in state.

2. The plug-in contact as claimed in claim 1, wherein the terminal region and the second regions of the contact legs run essentially parallel to one another.

3. The plug-in contact as claimed in claim 1, wherein the two contact legs have a wave-shaped outside contour which extends in the longitudinal direction.

4. A plug-in contact for making electrical contact with a circuit board by plugging the plug-in contact into a contact hole of the circuit board, comprising:

two contact legs which are resilient relative to one another, a terminal region and a connecting region which connects the two contact legs to one another and to the terminal region, wherein the two contact legs and the connecting region of the plug-in contact are made of a metallic material in one piece, wherein the two contact legs each have a first region and a second region which are arranged at an angle α to one another so that the two contact legs are bent substantially in an L-shape, wherein the first regions adjoin the connecting region and ends of the second regions form free ends of the contact legs, wherein the second regions of two contact legs each have a contact-making region which makes contact with the contact hole in a plugged-in state creating an electrical conducting path from the contact-making region to the terminal region, and wherein the two contact legs are of different lengths, a guide section being formed on the free end of a longer of the two contact legs, the guide section being located in a plug-in direction of the plug-in contact upstream of the free end of the shorter contact leg.

5. An electrical terminal, comprising:

a housing, with a spring clip, a busbar piece, and a plug-in contact, the spring clip having a clamping leg and a contact leg, wherein the clamping leg together with the busbar piece form a spring force clamp terminal for an electrical lead which is to be connected, wherein a lead insertion opening is provided in the housing for inserting an electrical lead which is to be connected wherein an actuation opening for opening the spring force clamp terminal is provided in the housing, wherein the plug-in contact comprising:

two contact legs which are resilient relative to one another, a terminal region and a connecting region which connects the two contact legs to one another and to the terminal region in one piece, wherein the two contact legs each have a first region and a second region which are arranged at an angle $\alpha$ to one another so that the two contact legs are bent substantially in an L-shape, the first regions adjoining the connecting region and ends of the second regions forming free ends of the contact legs, wherein the plug-in contact is arranged in the housing such that the busbar piece is formed by the terminal region of the plug-in contact and the contact legs with their second regions protrude from a bottom of the housing facing a circuit board with the first region and the connecting region being located within the housing, and wherein the second regions of two contact legs each have a contact-making region which makes contact with a contact hole of the circuit board in a plugged-in state creating an electrical conducting path from the contact-making region to the busbar piece.

6. The electrical terminal as claimed in claim 5, wherein several grooves or indents are made on the side of the terminal region of the plug-in contact facing the clamping leg.

7. The electrical terminal as claimed in claim 5, wherein on the bottom of the housing several adjusting elements are made for plugging into corresponding recesses in a circuit board.

8. The electrical terminal as claimed in claim 5, wherein several locking elements are made on the bottom of the housing for plugging into corresponding recesses in a circuit board.

9. The electrical terminal as claimed in claim 5, wherein an actuating pusher is arranged in the actuation opening such that the actuating pusher can be moved out of a first position in which the spring force clamp terminal is closed into a second position in which the actuating pusher deflects the clamping leg against the spring force of the spring clip with its end facing the clamping leg so that the spring force clamp terminal is opened.

* * * * *